US007611146B2

(12) United States Patent
Arden

(10) Patent No.: US 7,611,146 B2
(45) Date of Patent: Nov. 3, 2009

(54) GAMING APPARATUS AND METHOD OF EMPLOYING THE SAME

(76) Inventor: Wayne R. Arden, 430 Oak St., Steamboat Springs, CO (US) 80477

( * ) Notice: Subject to any disclaimer, the term of this patent is extended or adjusted under 35 U.S.C. 154(b) by 603 days.

(21) Appl. No.: 11/423,085

(22) Filed: Jun. 8, 2006

(65) Prior Publication Data

US 2007/0284824 A1 Dec. 13, 2007

(51) Int. Cl.
*A63F 67/00* (2006.01)

(52) U.S. Cl. ..... 273/317; 273/317.3; 273/348; 473/505

(58) Field of Classification Search ..... 273/317, 273/317.3, 329–331, 348, 399, 412; 473/505; 220/735, 752, 756
See application file for complete search history.

(56) References Cited

U.S. PATENT DOCUMENTS 503,022 A * 8/1893 Whitburn ..... 273/399
986,157 A * 3/1911 Fleming ..... 273/317
1,661,292 A * 3/1928 Klaus ..... 273/331
2,232,738 A * 2/1941 Serr ..... 220/751
3,012,785 A * 12/1961 O'Brien ..... 473/512
3,092,387 A * 6/1963 Wagner ..... 273/317.3
3,126,204 A * 3/1964 Devlin ..... 273/329
3,525,318 A * 8/1970 Kohner et al. ..... 124/7
3,565,432 A * 2/1971 Reiner et al. ..... 273/412
3,794,325 A * 2/1974 Stender ..... 273/399
4,136,872 A * 1/1979 Matsumoto ..... 273/317.3
4,979,753 A * 12/1990 Kobayashi ..... 273/399
4,993,767 A * 2/1991 Song ..... 294/31.1
5,029,700 A * 7/1991 Chen ..... 206/217
5,105,963 A * 4/1992 Scott ..... 220/735
5,492,334 A * 2/1996 Carignan et al. ..... 273/399
5,829,751 A * 11/1998 Willis ..... 273/330
6,032,822 A * 3/2000 Munari ..... 220/573.1
6,065,629 A * 5/2000 Sarnoff et al. ..... 220/315
7,207,564 B2 * 4/2007 Bedford et al. ..... 273/317
2004/0206761 A1 * 10/2004 Frantz ..... 220/570
2007/0284824 A1 * 12/2007 Arden ..... 273/317

* cited by examiner

*Primary Examiner*—Raleigh W. Chiu
(74) *Attorney, Agent, or Firm*—Holland & Hart LLP

(57) ABSTRACT

Provided is a game apparatus wherein a player may attempt to score a goal by means of a projectile. The gaming apparatus includes a handheld launcher which has a ramp portion configured such that the player may launch the projectile up and away from the launcher. The apparatus also includes a target supported in spaced relation relative to the launcher that defines a goal for the projectile.

25 Claims, 7 Drawing Sheets

GAMING APPARATUS AND METHOD OF EMPLOYING THE SAME

BACKGROUND

Children of all ages are continually seeking new ways to entertain and challenge themselves. To that end, an untold number of games have been developed that range on a continuum from team sports to board games. On one end of the continuum, sports are excellent for physical conditioning and the development of hand-eye coordination, however sports require a large amount of space, lots of equipment, and usually a multitude of opponents and teammates. On the other end of the continuum are board games. While requiring very little equipment and space, board games only challenge one's wit and are necessarily a sedentary activity.

Accordingly, a category of games has evolved that fills the middle of the continuum. These games require very little equipment or space and are suitable for play at almost any time or place, yet still actively engage the participant and require a great deal of hand-eye coordination. One familiar example of this type of game is the ball and cup game or Bolero as it is known in Latin American countries. This game typically consists of a small cup attached to the end of a small stick or handle. A string, usually attached to the base of the cup and sometimes around the handle, is used to tether a small ball. The ball is sized and selected to fit into the cup with a given clearance that ultimately determines the difficulty of the game. In order to play the game, the player swings the handle, which throws the ball against the tether, in an attempt to land the ball in the cup. The cup is the goal and the object of the game is to put the ball in the goal. Accordingly, the amount of clearance between the ball and the cup determines how difficult it is to swing the ball into the cup. This type of game requires a great deal of skill and hand-eye coordination. However, this particular game device has one drawback, in that the string attached to the ball has an adverse effect on the otherwise natural flight of the ball due to air resistance and gravity. The string on this device causes the ball to fly in an erratic, unnatural, and random fashion. As such it detracts from the enjoyment of playing the game because there are factors that cannot be controlled by the player.

There is a need for a new type of cup game that tests the users skills and hand eye coordination in a more realistic manner yet retains the advantage of being able to play the game in a limited amount of space and with very little equipment. This new game should allow for natural unrestricted flight of the ball. Not only should this new type of game be fun to play, but it also should be useful as a warm-up for activities requiring hand-eye coordination, skill, and a reflex type reaction to gravity's effect on a ball. For example, a basketball player or baseball pitcher cannot shoot baskets or throw pitches 24 hours a day. To do so would likely cause injury. As an alternative to overtraining, this new type of game could be employed to develop the participant's hand eye coordination and skill. By playing this game, the player could develop a reflexive or intuitive sense of how a ball will react to given input relative to gravity and air resistance. Additionally, playing this game may be useful to rehabilitate patients with injuries or conditions that result in a loss of coordination, such as a stroke victim.

SUMMARY

Provided is a game apparatus wherein a player may attempt to score a goal by means of a projectile. The gaming apparatus includes a handheld launcher which has a ramp portion configured such that the player may launch the projectile up and away from the launcher. Alternatively, the game apparatus may be adapted to rest on a support surface such as a tabletop. The apparatus also includes a target supported in spaced relation relative to the launcher that defines a goal for the projectile.

There are many launcher designs, which can provide a suitable ramp portion for launching projectiles. For example, the launcher may be bowl-shaped where the curved walls of the bowl provide a ramp portion for launching the projectile. It should be noted, however, that the ramp portion may be configured in a variety of different ways. For instance, the ramp portion may be curved or may simply be a flat ramp. In the case of a curved ramp portion, the ramp may extend along the surface of an imaginary sphere or it may be parabolic, hyperbolic, elliptical, or egg-shaped.

The target may be spaced relative to the launcher in several different locations. For example, in the case of a bowl shaped launcher, the bowl has an upper rim which defines a first plane and the target is supported in a second plane. The second plane may be spaced above the first plane, below the first plane, or coplanar with the first plane. The launcher may also include a handle that is adapted to be held by the hand of the player. The target may be spaced relative to the launcher from the handle or from the launcher itself.

The target may be designed in several different ways. For example, the target may be a hoop that is dimensioned such that the projectile may pass therethrough. Alternatively, the target may be a small cup sized and configured to catch the projectile. In yet another embodiment, the target may be a disk covered with one component of hook and loop material with the projectile being covered with the mating component of the material. Also, the target may include a plurality of goals each of which is of varying difficulty.

It is also contemplated that the gaming apparatus may include a sensor that is operative to register scored goals. In addition, the apparatus may include an indicator for displaying registered goals. The apparatus may also include a timer operative to place a time limit on the player's attempts to score goals with the projectile. It should be understood that the sensor, indicator, and timer may all be interconnected via electronic circuitry that is well known in the art.

Having provided for a gaming apparatus as described above, it should be understood that a method of employing the apparatus to improve a person's hand eye coordination is also provided. The method is comprised of first providing a gaming apparatus that includes either a handheld launcher or a tabletop launcher that has a ramp portion configured such that the player may launch a projectile therefrom, and a target supported in spaced relation relative to the launcher that defines a goal for the projectile. Next, the player places the projectile into the launcher, launching said projectile up in the air, and finally, in the case of the handheld launcher, maneuvering the apparatus in an attempt to score a goal on the target. The player would repeat these steps in an attempt to score as many goals as possible in, for instance, a given period of time, or score as many goals as possible in a row. The method may also be performed in conjunction with a sensor, an indicator for scored goals, and a timer. By starting a timer, the player may be challenged to register as many goals as possible in a set period of time.

DETAILED DESCRIPTION

Figure 1:
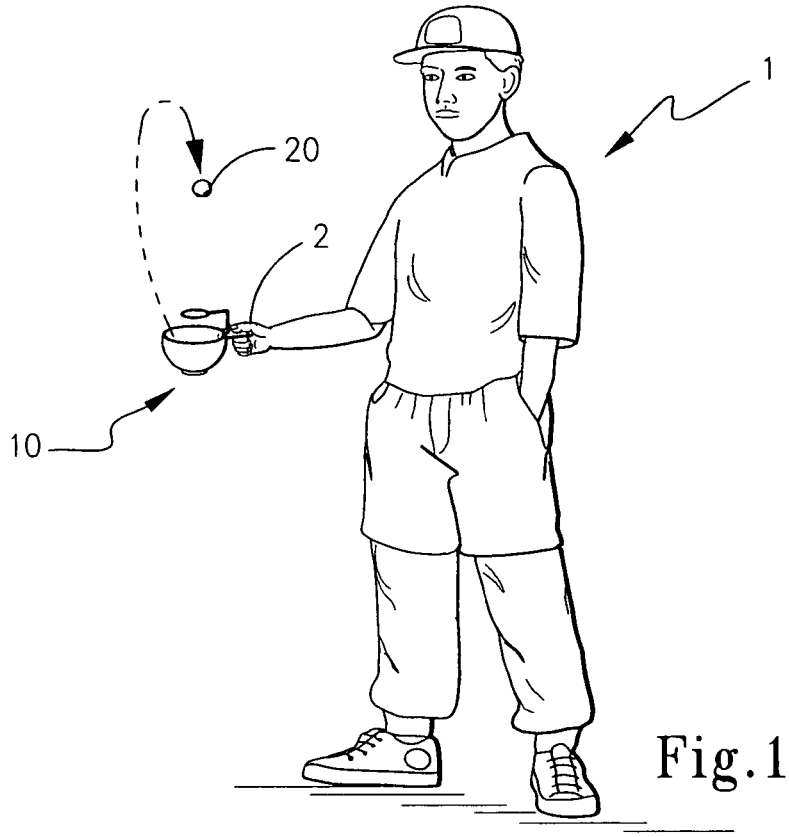
FIG. 1 is an isometric view illustrating a player employing a first embodiment of the gaming apparatus according to the present invention.

FIG. 1 illustrates a player 1 grasping with his right hand 2 the game apparatus 10 according to a first embodiment of the present invention. With reference to both FIGS. 1 and 2, the game is played by first placing the projectile 20 into opening 43 of the game apparatus 10. Next, player 1 may launch the projectile 20 from the game apparatus 10 by either throwing his arm or flicking his wrist in order to launch the projectile 20, as is depicted in FIG. 1. After the projectile 20 is launched the player 1 attempts to score a goal on target 30 by maneuvering the apparatus 10 and correspondingly target 30 into position such that projectile 20 passes through hoop 32.

Figure 2:
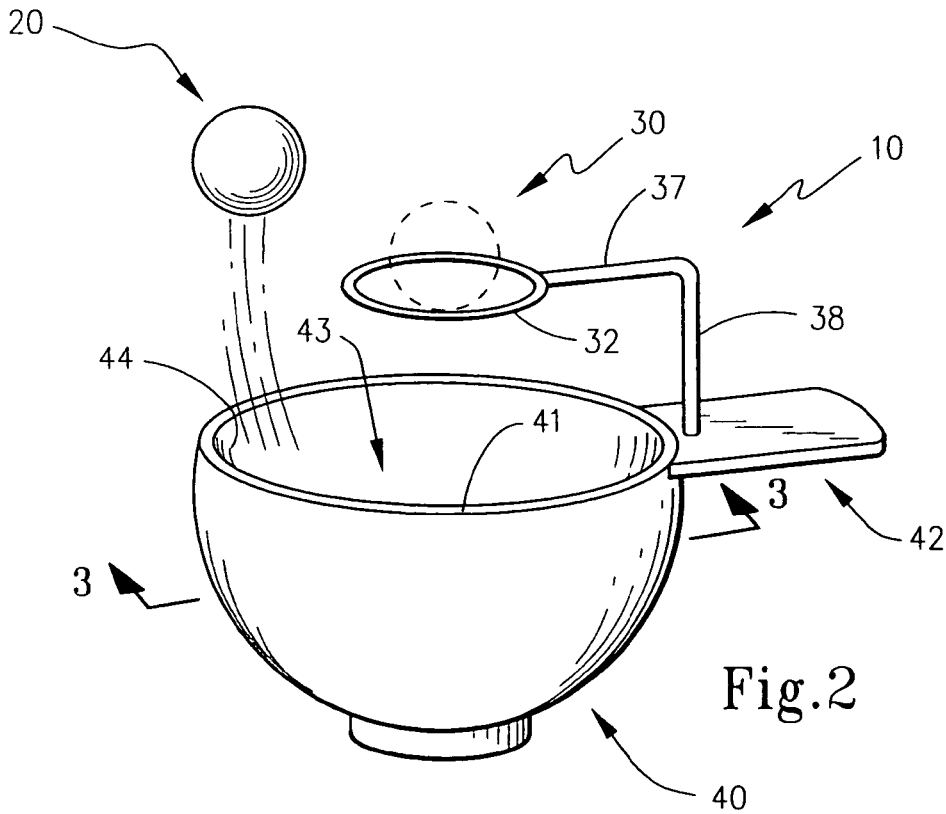
FIG. 2 is an isometric view of the first embodiment of the game apparatus introduced in FIG. 1.
Figure 3:
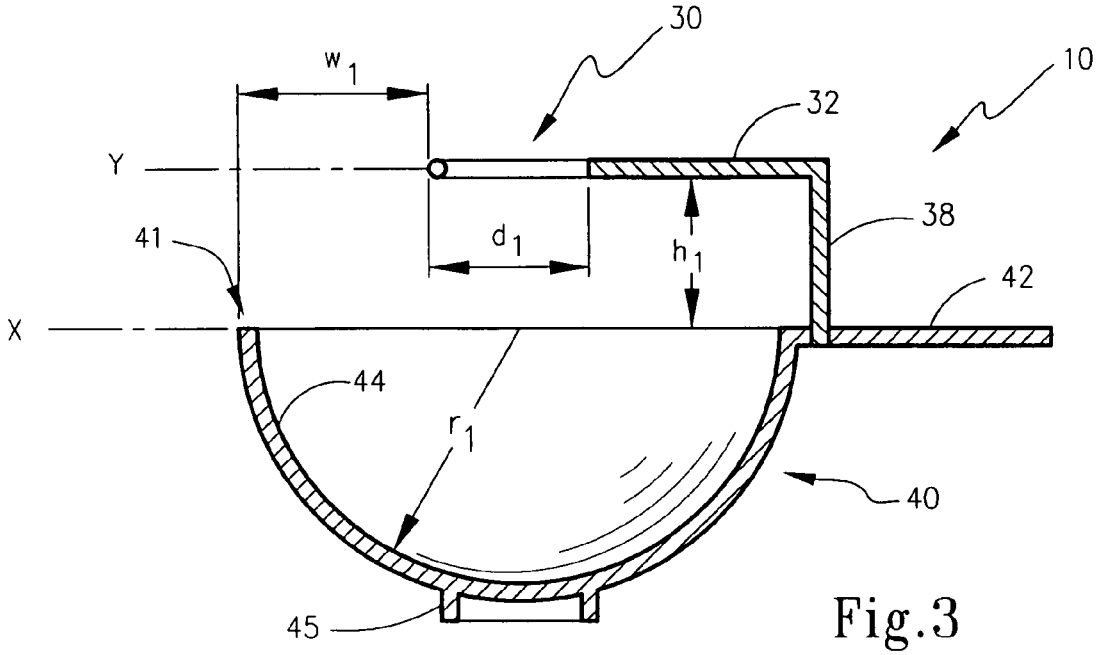
FIG. 3 is a cross-sectional view taken about section line 3-3 of FIG. 2.

FIGS. 2 and 3 depict the game apparatus 10 shown in FIG. 1 with greater detail. Here it may be seen that apparatus 10 includes a hand held launcher 40 that supports a target 30. Launcher 40 includes a handle 42 and a ramp portion 44 that is configured such that the player may launch a projectile 20 into the air. The projectile may be, for instance, spherical in shape with a soft covering such as felt to dampen noise and decrease bounce. In this embodiment the launcher 40 is bowl shaped with a rim 41 that encircles and defines opening 43. In this embodiment, target 30 simply consists of a hoop 32 sized and configured such that projectile 20 may pass therethrough. Hoop 32 is supported by an L-shaped arm composed of horizontal member 37 and vertical member 38, which in this case projects upwardly from handle 42.

FIG. 3 is a cross-sectional view about section line 3-3 of FIG. 2. As can be seen in FIG. 3 launcher 40 may be bowl shaped. By way of example and not to be construed as limiting, the inner surface of launcher 40 may extend along the surface of an imaginary sphere defined by radius $r_1$. Accordingly, ramp portion 44 would have a curved shape that also extends along a surface of an imaginary sphere. It should be understood that ramp portion 44 could alternatively be configured as a paraboloid, hyperboloid, or ellipse. At the bottom of the launcher is a base 45 designed to support the apparatus 10 on a support surface. In this embodiment the target 30 has a diameter $d_1$ and is spaced a distance $w_1$ from the rim 41 of the launcher opposite handle 42. Distance $w_1$ is selected such that projectile 20 can pass between rim 41 and target 30 during the step of launching the projectile 20.

Figure 4:
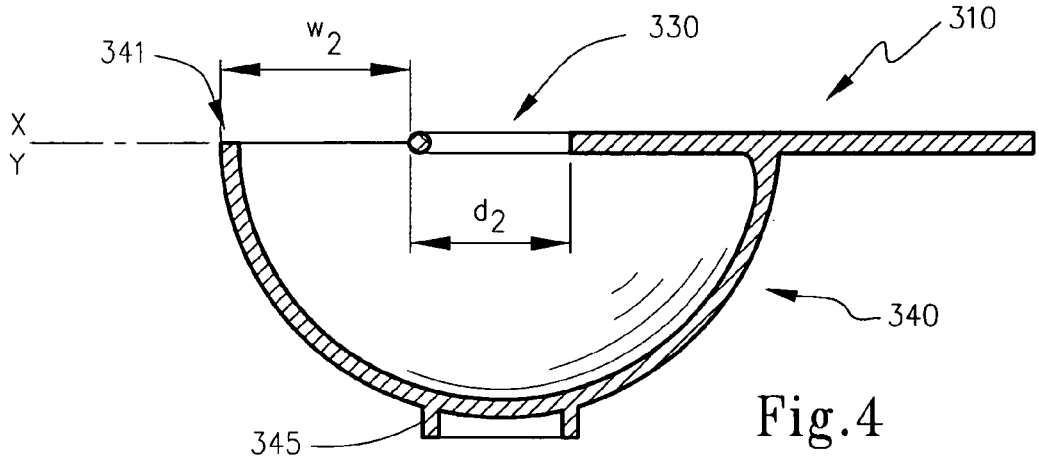
FIG. 4 is a cross-sectional view similar to FIG. 3 showing an alternative location of the target relative to the launcher.
Figure 5:
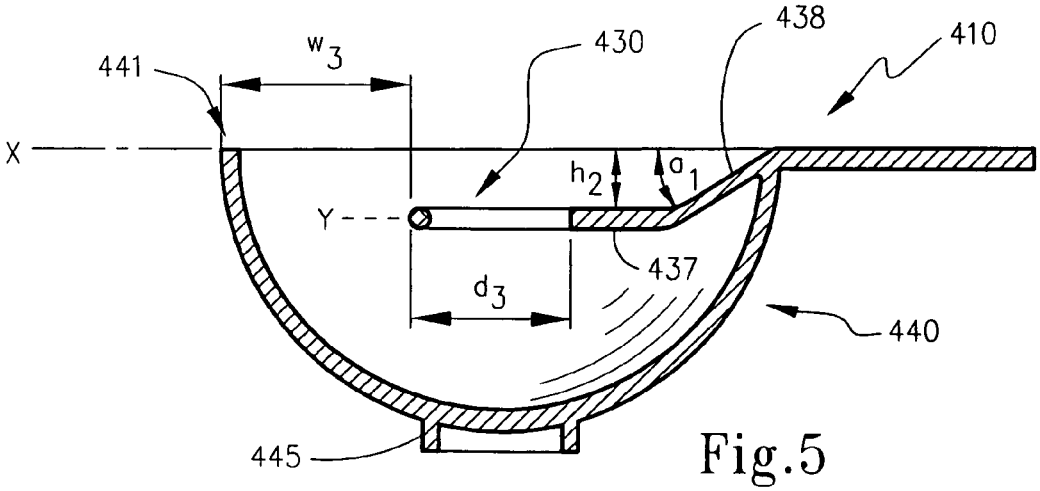
FIG. 5 is a cross-sectional view similar to FIG. 3 showing another alternative location of the target relative to the launcher.

The bowl shaped launcher in FIG. 3 includes an upper rim 41, which defines a first plane X. In FIG. 3 target 30 is comprised of a hoop, oriented in a second plane Y. FIG. 3 indicates that second plane Y is spaced relative and parallel to and above first plane X at a distance $h_1$. Alternatively, in FIG. 4, gaming apparatus 310 may have plane X that is, again, defined by upper rim portion 331 and plane Y defined by target 330 in a coplanar relationship. In this case the target has a diameter $d_2$ and is spaced a distance $w_2$ from the rim 341 of the launcher such that the projectile may pass therebetween. FIG. 5 shows yet another embodiment of the game apparatus 410 where target 430 is supported in plane Y that is spaced below and parallel to first plane X a distance $h_2$. Here again target 430 has a diameter $d_3$ and is spaced from the launcher rim 441 a distance $w_3$ such that the projectile may pass therebetween. Target 430 is supported by horizontal member 437 and member 438 that is angled down from rim 441 at an angle $a_1$ to support the target.

Figure 6:
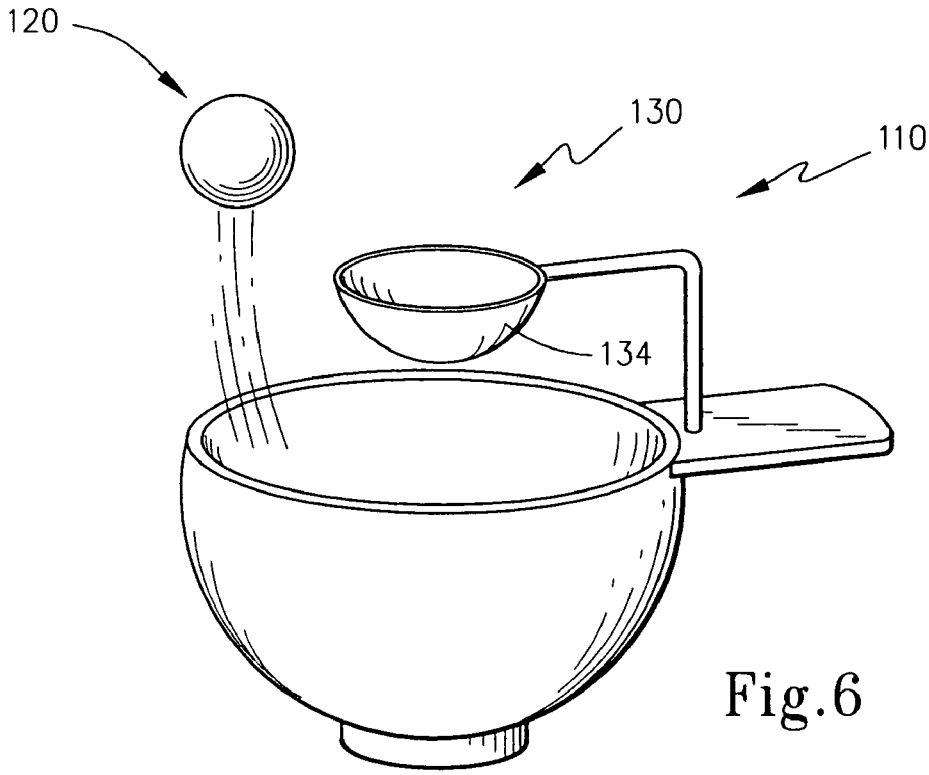
FIG. 6 is an isometric view of the game apparatus shown in FIG. 2 but having an alternative embodiment of the target.
Figure 7:
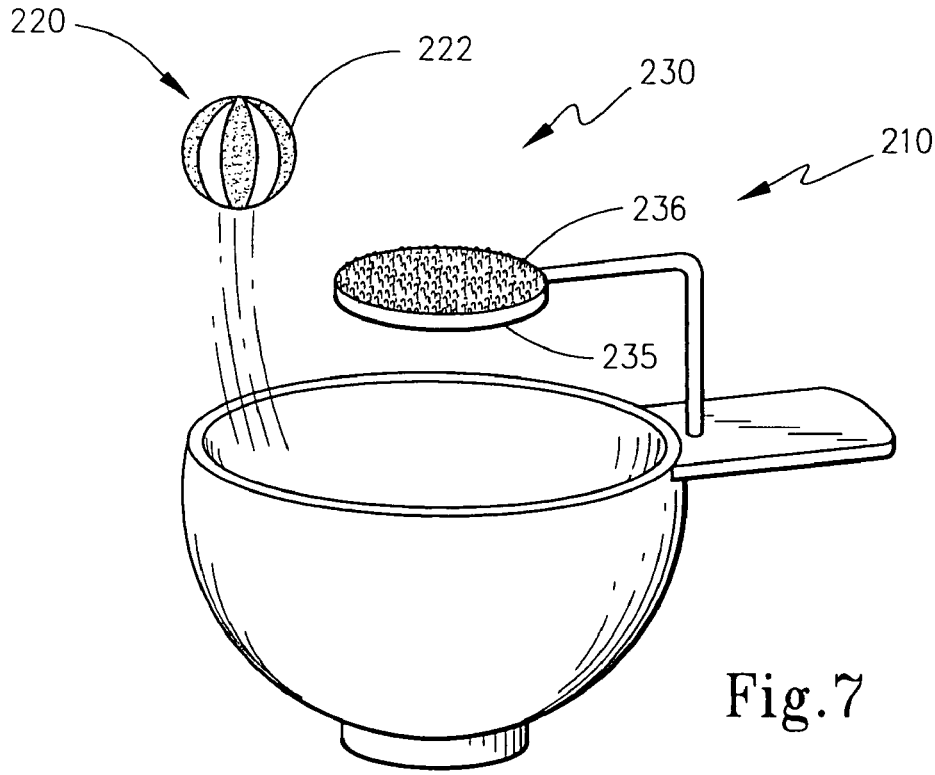
FIG. 7 is an isometric view of the game apparatus shown in FIG. 2 but having another alternative embodiment of the target.

FIG. 6 illustrates another embodiment of the game apparatus 110 where target 130 is formed as a small cup 134. Cup 134 is sized and configured such that projectile 120 may be received therein. FIG. 7 shows yet another embodiment 210 of the game apparatus. In this embodiment, the target 230 and the projectile 220 are covered with hook and loop material. It should be understood that the hook material may be disposed on either the target or the projectile. For example, target 230 is comprised of a disc 235 that is covered at least partially with hook material 236. Correspondingly, projectile 220 is at least partially covered with loop material 222. Upon launching projectile 220 and thereafter successfully hitting target 230, the projectile 220 will stick to disc 235 as the hook and loop material 222, 236 come in contact with each other.

Figure 8:
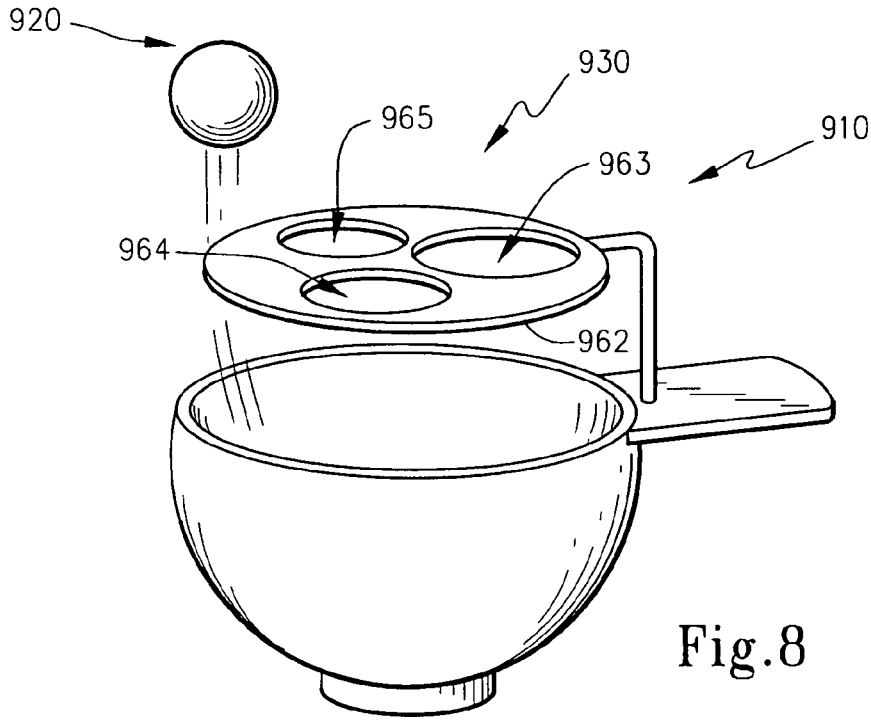
FIG. 8 is an isometric view of the game apparatus shown in FIG. 2 but having an alternative embodiment of the target, which has multiple goals.
Figure 9:
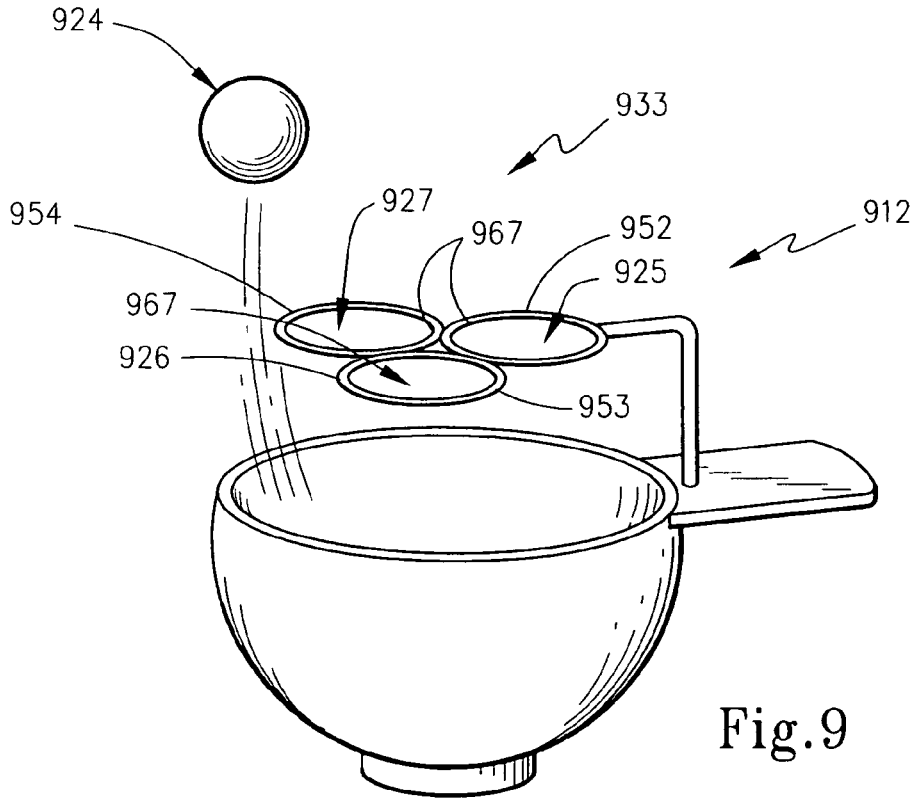
FIG. 9 is an isometric view of the game apparatus shown in FIG. 2 but having another alternative embodiment of the target, which has multiple goals.

FIG. 8 illustrates an embodiment of the game apparatus 910 with a multiple goal target 930. In this embodiment the target is a flat disk 962 with a plurality of goals 963, 964, and 965 formed therethrough. Each goal is of a different size relative to the projectile 920. For instance, goal 965 is only slightly larger in diameter than projectile 920 thereby making it difficult to score on goal 925. Conversely, goal 963 is very large in diameter compared to the projectile 920. Goal 964 has a diameter between goal 965 and 963. Various scoring schemes are possible with such a multi-goal target. Points could be allocated based on the difficulty of scoring on a particular diameter goal. Also, the scheme might require that a player score on each goal in succession from easiest to most difficult (i.e. from largest diameter to smallest diameter). FIG. 9 represents an alternative construction of a multi-goal target. In this embodiment 912 the target 933 is constructed of several rings that form multiple goals. Specifically, goals 925, 926, and 927 are formed by rings 952, 953, and 954 respectively. The rings are secured to each other where they meet at tangent points 967. The rings may be secured together by brazing, gluing, or the like. Alternatively, the goals may be formed from plastic by stamping, molding, gluing or the like. While the figures indicate three equal diameter goals, the number and size of the goals can vary. Similarly, the goals can all be of the same diameter but with a color code associated with each goal representing a selected point value.

Figure 10:
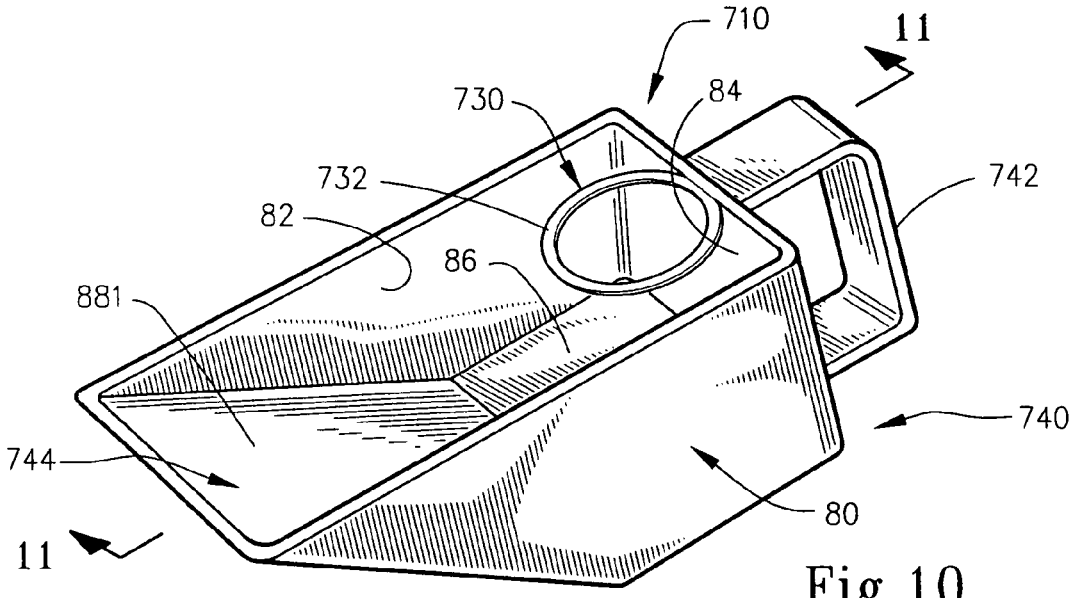
FIG. 10 is an isometric view of another embodiment of the game apparatus.
Figure 11:
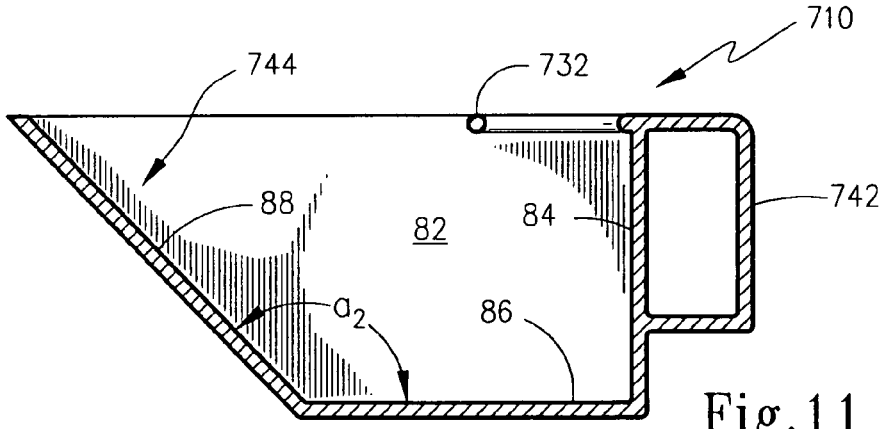
FIG. 11 is a cross-sectional view taken about section line 11-11 of FIG. 10.
Figure 12:
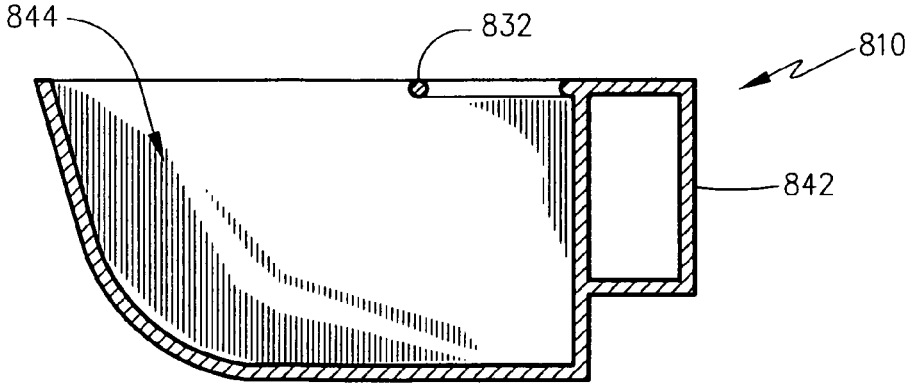
FIG. 12 is a cross-sectional view similar to FIG. 11 but where the ramp portion is parabolic in shape.

FIGS. 10 and 11 depict another embodiment of the game apparatus 710 where the launcher 740 is constructed of parallel sidewalls 80 and 82 that are connected orthogonally to end wall 84 and base wall 86. Ramp portion 744 is comprised of planar ramp wall 88 that is disposed between side walls 80 and 82 and angled relative to base wall 86 at a selected obtuse angle $a_2$ which, for example, may be about 135°. Launcher 740 also includes handle 742 and target 730. Target hoop 732 is directly supported by end wall 84 in this example. FIG. 12 shows another embodiment of a game apparatus 810 similar to the embodiment depicted in FIGS. 10 and 11 but with a ramp portion 844 that is parabolic rather than planar.

Figure 13:
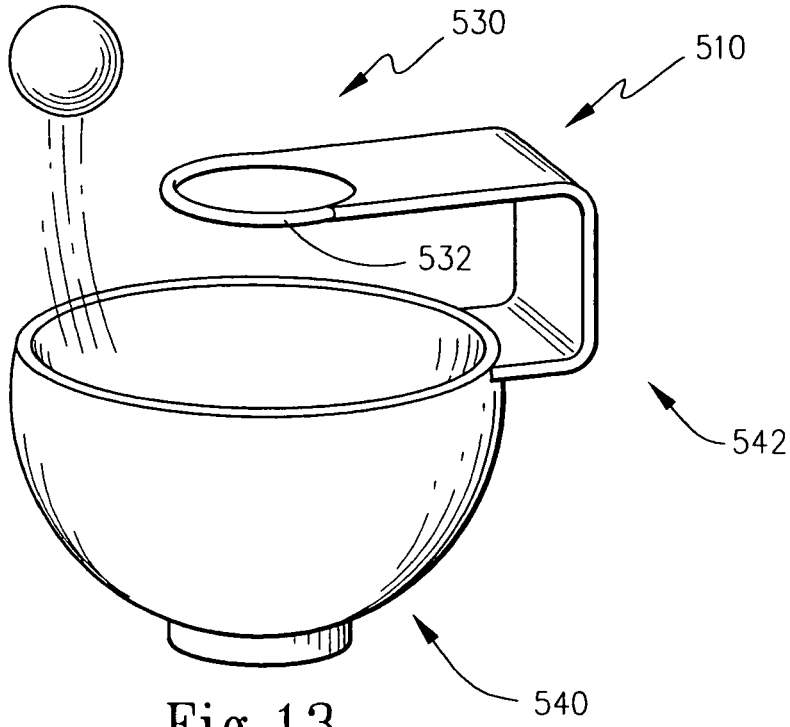
FIG. 13 is an isometric view similar to FIG. 1 showing an alternative embodiment of the handle.
Figure 14:
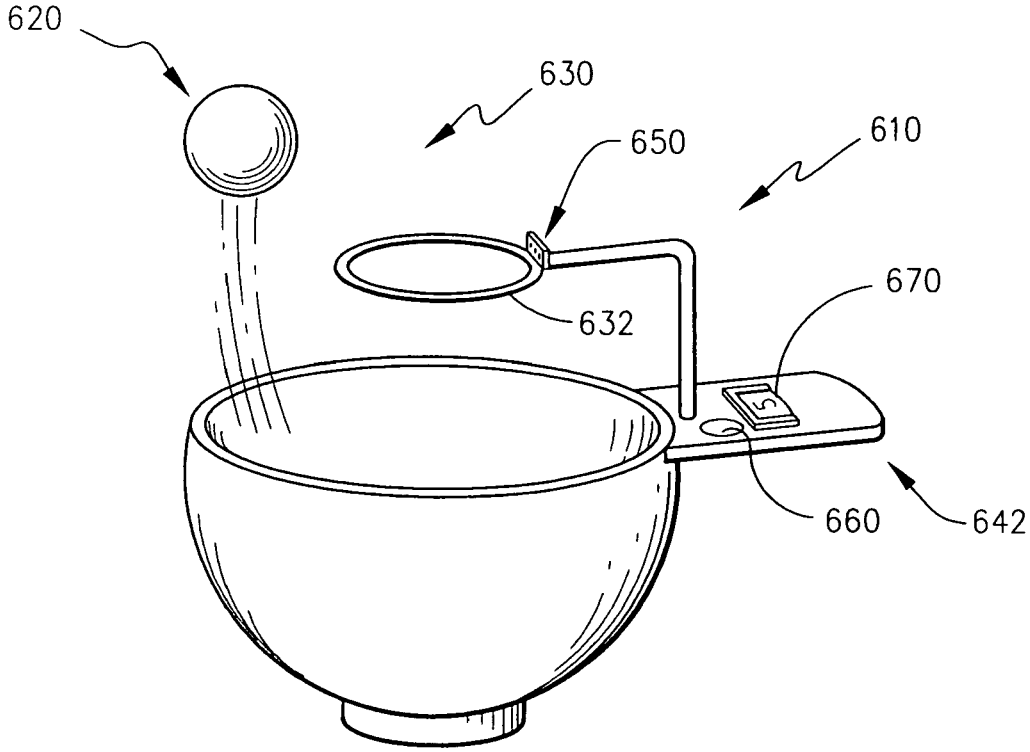
FIG. 14 is an isometric view of the game apparatus showing a sensor, indicator, and a timer.

It should be understood that the handle portion of the launcher may be configured in various different ways. For example, FIG. 13 shows an embodiment 510 where handle 542 is structured to also support target 530 in the form of hoop 532. FIG. 14 illustrates a further embodiment of the game apparatus that includes a sensor 650 that will register when projectile 620 passes through target 630. Sensor 650 may be, for example, a retroreflective LED sensor, which are well known in the art. Upon registering a goal, sensor 650 communicates with indicator 670 to display the score. A timer 660 may also be employed to set a time limit on how long the player has to score goals. Indicator 670 may be simply a series of LED's or it may be a liquid crystal display. Timer 660 may be implemented as either a mechanical wind up timer or preferably in the form of an electronic timing circuit. The interconnection and control of sensor 650, display 670, and timer 660 may be accomplished electronically, as is well known in the art.

Figure 15:
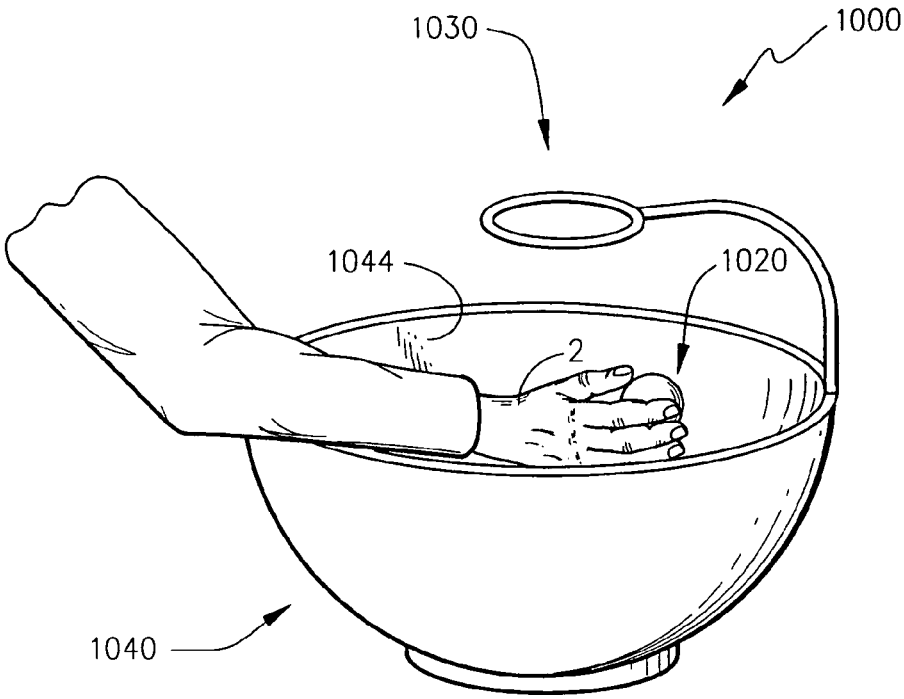
FIG. 15 is an isometric view of another embodiment of the game apparatus.
Figure 16:
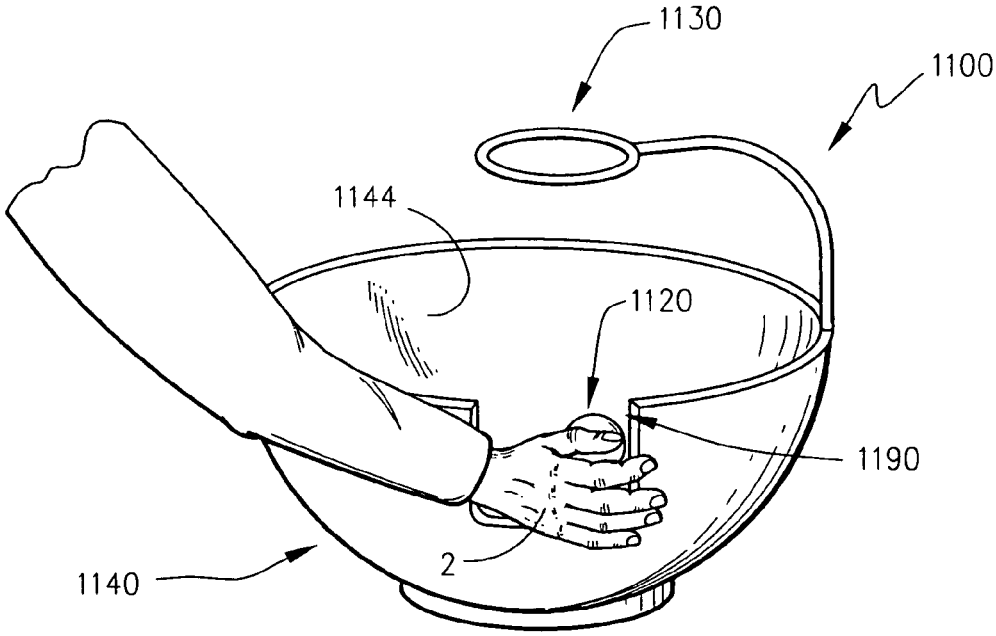
FIG. 16 is an isometric view of the game apparatus similar to FIG. 15 showing an alternative embodiment of the launcher.

In another embodiment of the game apparatus the launcher remains stationary on a surface such as a table. As is illustrated in FIG. 15, the game apparatus 1000 includes a launcher 1040 that is sized and configured such that the player's hand 2 can fit into the launcher 1040 to propel the projectile 1020 along ramp portion 1044. In this embodiment the player attempts to score a goal on target 1030 only by launching the projectile 1020. In contrast to the previous embodiments described above, in this case the player does not maneuver the game apparatus in order to score a goal. The player must rely only on his skill at launching the projectile 1020. FIG. 16 illustrates an embodiment of the game apparatus similar to that of FIG. 15 but with the addition of an opening 1190 in the side of the launcher 1140. Opening 1190 should be sized and configured to allow the player's hand 2 to fit into the launcher 1140 for propelling the projectile 1120 along the ramp portion 1144.

A method is also contemplated for improving a person's hand-eye coordination. This method may include any steps inherent in any of the disclosed embodiments. Broadly, the method includes the step of providing a gaming apparatus that includes a launcher with a ramp portion configured such that the player may launch a projectile therefrom and a target supported in spaced relation relative to said launcher to define a goal for the projectile. The player then places a projectile in the launcher and launches said projectile. In the case of a handheld launcher, once the projectile has been launched, the player maneuvers the apparatus in an attempt to score a goal on the target. The steps of placing the projectile in the launcher, launching the projectile in attempting to score a goal may be repeated numerous times. It should be further understood that each time a goal is scored that the goal may be tallied. In addition, a timer may be employed to add challenge to the game by limiting the amount of time and thereby the number of attempts the player may attempt to score a goal. While it is contemplated that a player can keep score if desired, keeping score is not required to enjoy the challenge and entertainment afforded by the gaming apparatus described herein.

Accordingly, the present invention has been described with some degree of particularity directed to certain exemplary embodiments. Those of skill in the art, though, will recognize that certain modifications, permutations, additions and subcombinations thereof are within the true spirit and scope of the various embodiments.

I claim:

1. A handheld gaming apparatus, comprising:

(A) a projectile:

(B) a handheld launcher including a handle, and a ramp portion configured such that the player may launch the projectile therefrom; and (C) a target supported in spaced relation relative to said launcher to define a goal for the projectile.

2. A handheld gaming apparatus according to claim 1 wherein said launcher is bowl-shaped.

3. A handheld gaming apparatus according to claim 2 wherein said bowl-shaped launcher has a continuous upper rim defining a first plane and wherein said target is a hoop supported in a second plane that is approximately parallel to said first plane.

4. A handheld gaming apparatus according to claim 3 wherein said second plane is spaced above said first plane.

5. A handheld gaming apparatus according to claim 3 wherein said second plane is spaced below said first plane.

6. A handheld gaming apparatus according to claim 3 wherein said second plane is spaced coplanar with said first plane.

7. A handheld gaming apparatus according to claim 1 wherein said target is supported by said handle.

8. A handheld gaming apparatus according to claim 1 wherein said target is a hoop dimensioned such that the projectile may pass therethrough.

9. A handheld gaming apparatus according to claim 1 wherein said target defines a plurality of goals for the projectile.

10. A handheld gaming apparatus according to claim 1 wherein said launcher has an opening located on a side of the launcher to accommodate the player's hand and to allow the player to propel the projectile around the ramp portion.

11. A handheld gaming apparatus according to claim 1 wherein said target is attached directly to said launcher.

12. A handheld gaming apparatus wherein a player may attempt to score a goal comprising:

(A) a projectile;

(B) a launcher sized and adapted to be held by a hand of the player, said launcher including a ramp portion configured such that the player may launch said projectile therefrom; and (C) a target supported in spaced relation relative to said launcher, said target including a plurality of goals for the projectile.

13. A handheld gaming apparatus according to claim 12 wherein said apparatus includes a sensor operative to register scored goals.

14. A handheld gaming apparatus according to claim 13 wherein said apparatus includes an indicator for displaying goals registered by said sensor.

15. A handheld gaming apparatus according to claim 14 wherein said apparatus includes a timer.

16. A handheld gaming apparatus for use by a player comprising:

(A) a projectile;

(B) a launcher including a handle that is sized and adapted to be held by the player and a curved ramp portion configured such that the player may launch said projectile therefrom, said handle having a proximal end joined to said launcher and extending away from said launcher to terminate in a free distal end;

(C) a target supported in spaced relation relative to said launcher to define a goal for the projectile; and (D) an arm displaced from said handle to support the target, said arm having a portion which extends transversely to said handle.

17. A handheld gaming apparatus according to claim 16 wherein said ramp portion extends along the surface of an imaginary sphere.

18. A handheld gaming apparatus according to claim 16 wherein said ramp portion is parabolic in shape.

19. A gaming apparatus for use by a player comprising:

(A) a projectile;

(B) a bowl-shaped launcher including a support base and a curved ramp portion configured such that the player may launch said projectile therefrom;

(C) a target supported in spaced relation relative to said launcher to define a goal for the projectile; and (D) an overhanging arm positioning the target over a center of the launcher.

20. A handheld gaming apparatus wherein a player may attempt to score a goal by means of a projectile, comprising:

(A) a handheld, bowl-shaped launcher including a handle and a ramp portion configured such that the player may launch the projectile therefrom, said launcher having an upper rim defining a first plane; and (B) a target supported in spaced relation relative to said launcher to define a goal for the projectile, wherein said target is a hoop supported in a second plane that is approximately parallel to said first plane.

21. A handheld gaming apparatus according to claim 20 including at least one arm portion positioning said target over a center of the launcher.

22. A method of improving a person's hand-eye coordination comprising:

(A) providing a gaming apparatus that includes a handheld launcher with a ramp portion configured such that the player may launch a projectile therefrom and a target supported in spaced relation relative to said launcher to define a goal for the projectile;

(B) placing a projectile in said launcher;

(C) launching said projectile;

(D) maneuvering said apparatus in an attempt to score a goal; and (E) repeating steps (B) through (D).

23. A method of improving a person's hand-eye coordination according to claim 22 wherein the launcher is bowl-shaped.

24. A method of improving a person's hand-eye coordination according to claim 22 whereby said apparatus is maneuvered after launch of the projectile.

25. A method of improving the hand-eye coordination of a player comprising:

(A) providing a gaming apparatus that includes a handheld launcher with a ramp portion configured such that the player may launch a projectile therefrom and a target supported in spaced relation relative to said launcher to define a goal for the projectile;

(B) starting a timer;

(C) placing a projectile in said launcher;

(D) launching said projectile;

(E) maneuvering said launcher after launching the projectile in an attempt to score a goal; and (F) repeating steps (C) through (E) until said timer expires.

* * * * *

UNITED STATES PATENT AND TRADEMARK OFFICE

CERTIFICATE OF CORRECTION

PATENT NO. : 7,611,146 B2
APPLICATION NO. : 11/423085
DATED : November 3, 2009
INVENTOR(S) : Wayne R. Arden It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 751 days.

Signed and Sealed this

Twelfth Day of October, 2010

David J. Kappos

David J. Kappos
*Director of the United States Patent and Trademark Office*